US007680650B2

(12) United States Patent
Johnson

(10) Patent No.: US 7,680,650 B2
(45) Date of Patent: Mar. 16, 2010

(54) VERY LOW BIT RATE SPEECH TRANSMISSION SYSTEM

(75) Inventor: Paul Johnson, El Cajon, CA (US)

(73) Assignee: Trex Enterprises Corp., San Diego, CA (US)

( * ) Notice: Subject to any disclaimer, the term of this patent is extended or adjusted under 35 U.S.C. 154(b) by 698 days.

(21) Appl. No.: 11/652,814

(22) Filed: Jan. 12, 2007

(65) Prior Publication Data

US 2008/0172222 A1 Jul. 17, 2008

(51) Int. Cl.
*G10L 21/00* (2006.01)

(52) U.S. Cl. ..... 704/200; 704/258

(58) Field of Classification Search ..... 704/200, 704/258

See application file for complete search history.

(56) References Cited

U.S. PATENT DOCUMENTS 5,924,068 A * 7/1999 Richard et al. ..... 704/260
6,163,765 A * 12/2000 Andric et al. ..... 704/204
6,185,532 B1 * 2/2001 Lemaire et al. ..... 704/258

* cited by examiner

*Primary Examiner*—Susan McFadden
(74) *Attorney, Agent, or Firm*—John R. Ross

(57) ABSTRACT

A very low bit rate communication system. In preferred embodiments, an off-the-shelf module is adapted to convert a speaker's voice to text. A processor is provided to separate the text into individual words. The processor is programmed with a dictionary which provides pre-assigned specific 14-bit numeric values to each word in the dictionary (words used more frequently may be assigned shorter codes). The processor creates a numeric stream from 14-bit numeric values and this numeric stream is then transmitted to a receiver. Typical speech contains 4 words/second, so bit rates as low as 50 bits/second may be achieved with this technique. At the receiving end, the stream of received 14-bit numeric values, representing the speaker's words, are looked up in a dictionary identical to that at the transmitting end and the text of the words reconstructed. Text-to-speech techniques common to the industry are then used to regenerate the speech.

10 Claims, 3 Drawing Sheets

VERY LOW BIT RATE SPEECH TRANSMISSION SYSTEM

The present invention relates to communication systems and in particular to low bit rate speech communication systems.

BACKGROUND OF THE INVENTION

There are approximately 890,000 distinct words in the English language, but in general only 10,000 are in the vocabulary of the common educated person. In addition, some words are used much more frequently than others. For example, the top twenty most frequently used words in spoken English are: the, and, I, to, of, a, you, that, in, it, is, yes, was, this, but, on, well, he, have, and for.

It has been estimated that a typical person speaks at a rate of approximate 4 words per second, and that the average word is made of 6.66 phonemes. This means that approximately either 4 words or 27 phonemes per second must be transmitted to accurately convey the information. Definitions vary, but spoken English can be represented by approximately 50 distinct phonemes. Therefore, each of the phonemes can be represented distinctly as a 6-bit number. If phonemes were transmitted as a representation of the speech, approximately 162 bits/second would be required.

As an alternative to transmitting symbols representing phonemes, symbols representing the actual words can be transmitted. Estimates vary, but an educated person has a vocabulary of 10,000 words. A single 15-bit number can be assigned to each of the commonly used words (and word forms) in the English dictionary. If a person speaks at 4 words/second, then 60 bits/second would be necessary to represent the speech using this approach. As a further enhancement to this technique, shorter bit strings may be used to represent the most commonly used words, and even the most commonly used groups of words ("and the" for example). This technique may reduce the required bit rate to as little as 30 bits/second.

The human vocal tract can be represented as a glottal pulse train convolved through a vocal tract convolutional filter (of approximately 10 coefficients). The glottal pulse train represents the pitch of the speech and the filter coefficients determine the other sound characteristics. The pitch and the filter coefficients change as one speaks so each glottal pulse is convolved through a slightly different filter as one speaks to generate the sounds we hear. In an artificial speech generator, changing or updating the coefficients and pitch about 30 times/second is sufficient to generate natural sounding speech. Certain sounds, such as "ssss" or "zzz" do not contain the glottal pulse (are unvoiced), and can be represented as a sound directly from the filter, or with a much higher pitch frequency. Any given person will speak with a certain range of filter coefficients and glottal pulse shapes and frequency, giving them their particular speech sound. As one speaks, this range can be modeled and passed to the speech regenerator to help reconstitute speech that sounds like the original speaker. By passing only the range of pitch and filter coefficients, but not the coefficients themselves, little bandwidth is required to mimic the original speaker.

Prior art patents relating to the present invention include the following patents: U.S. Pat. No. 7,124,082, "Phonetic speech-to-text-to-speech system and method", Freedman, 2006; U.S. Pat. No. 6,035,273, "Speaker-specific speech-to-text/text-to-speech communication system with hypertext-indicated speech parameter changes", Spies, 1996; U.S. Pat. No. 5,724,410, "Two-way voice messaging terminal having a speech to text converter", Parvulescu, 1998.

SUMMARY OF THE INVENTION

The present invention provides a very low bit rate speech communication system. In preferred embodiments, an off-the-shelf module is adapted to convert a speaker's voice to text. A processor is provided to separate the text into individual words. The processor is programmed with a dictionary which provides a pre-assigned specific 14-bit numeric value (words used more frequently may be assigned shorter codes) for each word. The processor creates a numeric stream from 14-bit numeric values and this numeric stream is then transmitted to a receiver. Typical speech contains 4 words/second, so bit rates as low as 50 bits/second may be achieved with this technique. At the receiving end, the stream of received 14-bit numeric values, representing the speaker's words, are looked up in a dictionary identical to that at the transmitting end and the text of the words reconstructed. Text-to-speech techniques common to the industry are then used to regenerate the speech.

DETAILED DESCRIPTION OF PREFERRED EMBODIMENTS

Preferred embodiments of the present invention are described by reference to the drawings. In a first preferred embodiment, the speaker's sounds are converted to symbols representing words. These word symbols are then transmitted at the rate of four symbols per second. At the receiving end, the symbols are converted back to words and then to sound recognizable as speech.

Figure 1:
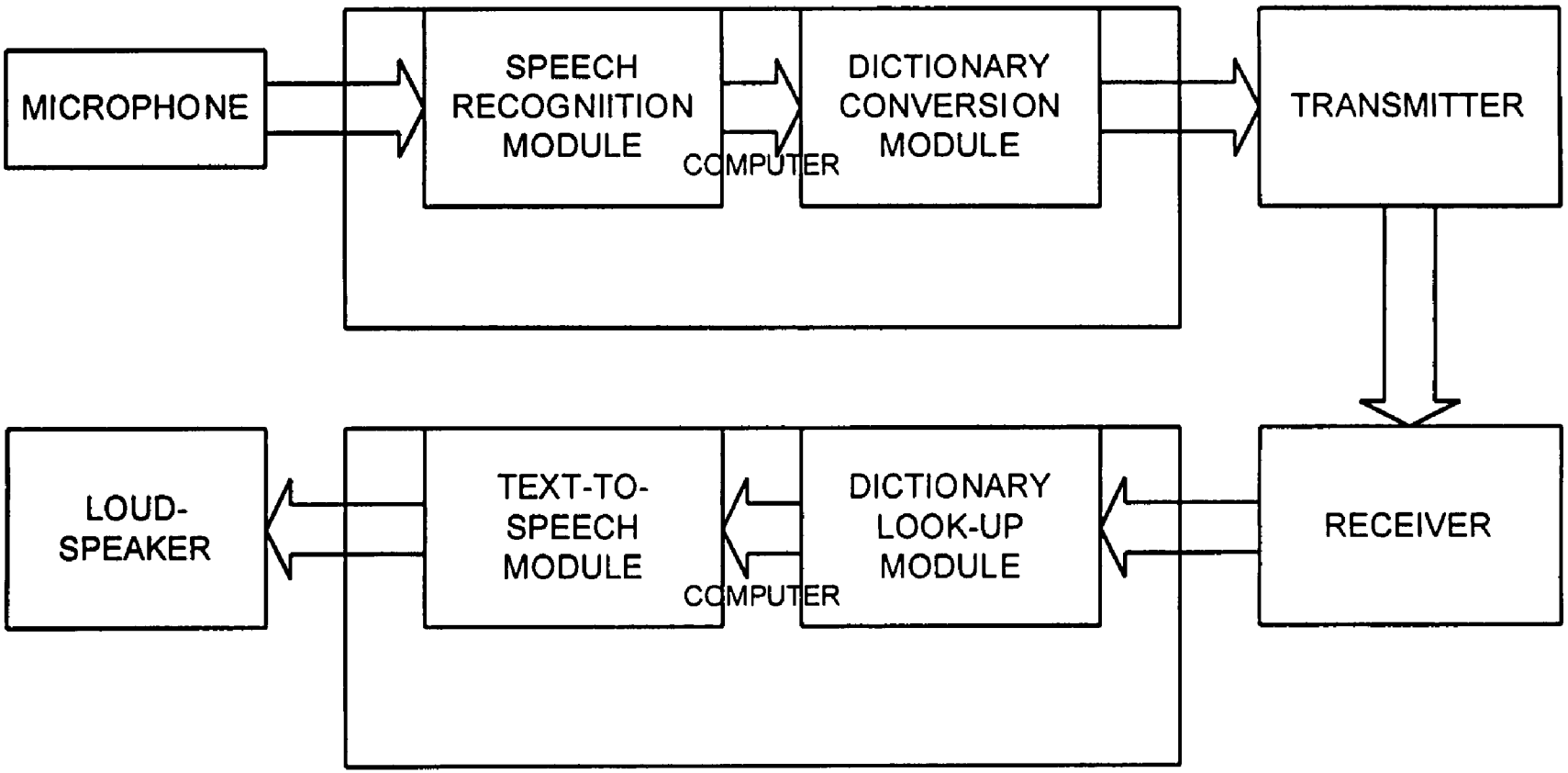
FIG. 1 is a block diagram describing a preferred embodiment of the present invention.
Figure 2:
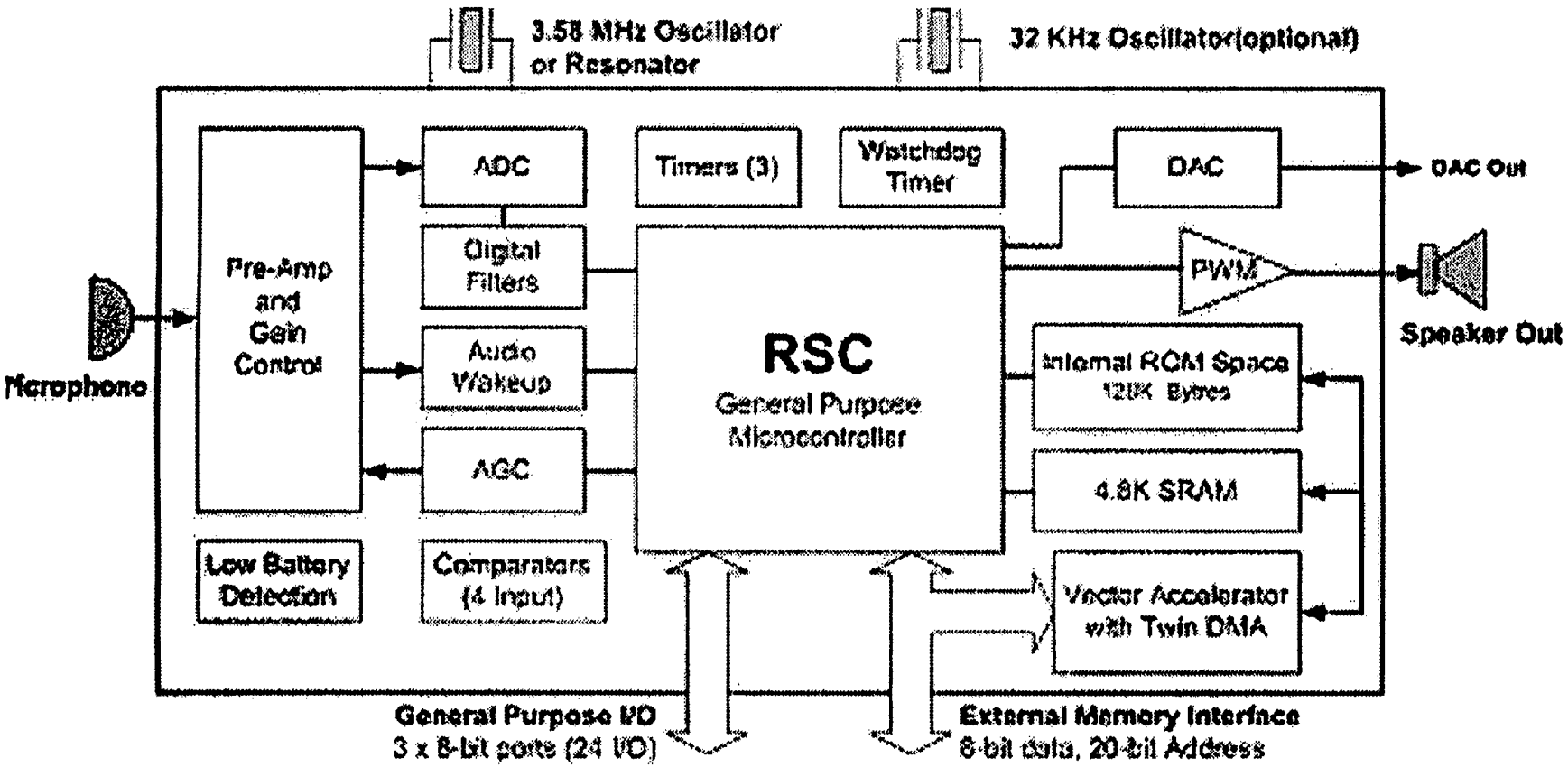
FIG. 2 is a block diagram of a prior art speech recognition and generation module from Sensory Inc.

FIG. 1 is a block diagram of the preferred embodiment. Microphone 1 converts the sound pressure waves of the speakers voice to an electrical signal which is digitized in Computer 2 and presented to speech recognition module 3 (such as Dragon Naturally Speaking software manufactured by Nuance Corporation or Microsoft's Speech to Text Engine). The output of speech recognition module 3 is a text string representing the speech. Dictionary conversion module 4 then converts the text output of module 3 to a series of 14-bit numbers, representing the words in the text string. The output of dictionary conversion module 4 is then passed to transmitter 5 for transmission at approximately 50 bits/second.

Receiver 6 receives the output of transmitter 5 and presents 14-bit digital words to dictionary look-up module 7, which creates a string of textual words corresponding to the 14-bit numbers. The output of dictionary look-up module 7 is presented to text-to-speech module 8 (such as Fonix DecTalk 5), which creates a waveform facsimile of the speaker's voice, based on the text from module 7. The waveform is presented by computer 9 to loudspeaker 10 which creates an acoustic wave that may be heard by listener.

In a preferred embodiment of the invention dictionary conversion module 4 and dictionary look-up module 7 are custom software applications developed using Microsoft Speech SDK 5.1 for the personal computer.

Audio Input

In the preferred embodiment of the invention, the audio input is derived from Microphone 1, but may alternatively be provide by another sound source such as a computer file, amplifier, telephone, radio, or other source.

Speech-to-Text

In the preferred embodiment of the invention, the audio speech recognition module is a customized version of the Microsoft Speech to Text engine as stated above. However, several other vendors are available with software and hardware to perform this function. In other embodiments of the invention, this module may also analyze the speaker's voice to determine pitch and vocal tract characteristics.

Dictionary Conversion

In the preferred embodiment of the invention, this is custom-written software that converts textual words to 14-bit numbers, using a 15,000 word common dictionary. In other embodiments of the invention, the dictionary may be customized to fit the particular context of speech or operating environment.

Dictionary Look-Up

In the preferred embodiment of the invention, this is custom-written software that converts 14-bit numbers to textual words, using a 15,000 word common dictionary. In other embodiments of the invention, the dictionary may be customized to fit the particular context of speech or operating environment.

Text-to-Speech

In the preferred embodiment of the invention, the Text-to-Speech function is performed using Fonix's DecTalkS software as stated above, which allows customization for multiple speakers (it has the ability to generate several different voices). The text-to-speech function is generic and may or may not be based on phoneme recognition. In other embodiments of the invention, the speaker's voice will be parameterized to mimic the sound of the speaker's voice. Several vendors provide both software and hardware products that perform the text-to-speech function.

Compression

Though not shown in the FIG. 1 drawing of the first preferred embodiment of the invention, the output of dictionary conversion module 1 may be digitally compressed either serially or in a block mode to reduce the data rate even further. In addition, data interleaving/de-interleaving (and error detection/correction) may be performed to mitigate the effects of drop-outs and bit errors in noisy or weak-signal conditions.

Encryption/Decryption

Although not shown in FIG. 1, any cipher can easily be applied to the bit stream output of dictionary conversion module 1 at these low data rates, including spread-spectrum coding for achieving low probability of intercept/low probability of detection (LPI/LPD). As an example, Blowfish is a strong cipher for this purpose because, as a block-mode cipher, it does not inflate the size of the bit-stream. Blowfish itself is license-free, is a fairly quick algorithm, has been shown to be resistant to attack, and is a generally-accepted drop-in replacement for DES or IDEA.

APPLICATIONS OF THE PRESENT INVENTION

There are many potential applications of the present invention some of which are outlined below and many of which will be obvious to persons skilled in the communication art:

Underwater Communications

Figure 3:
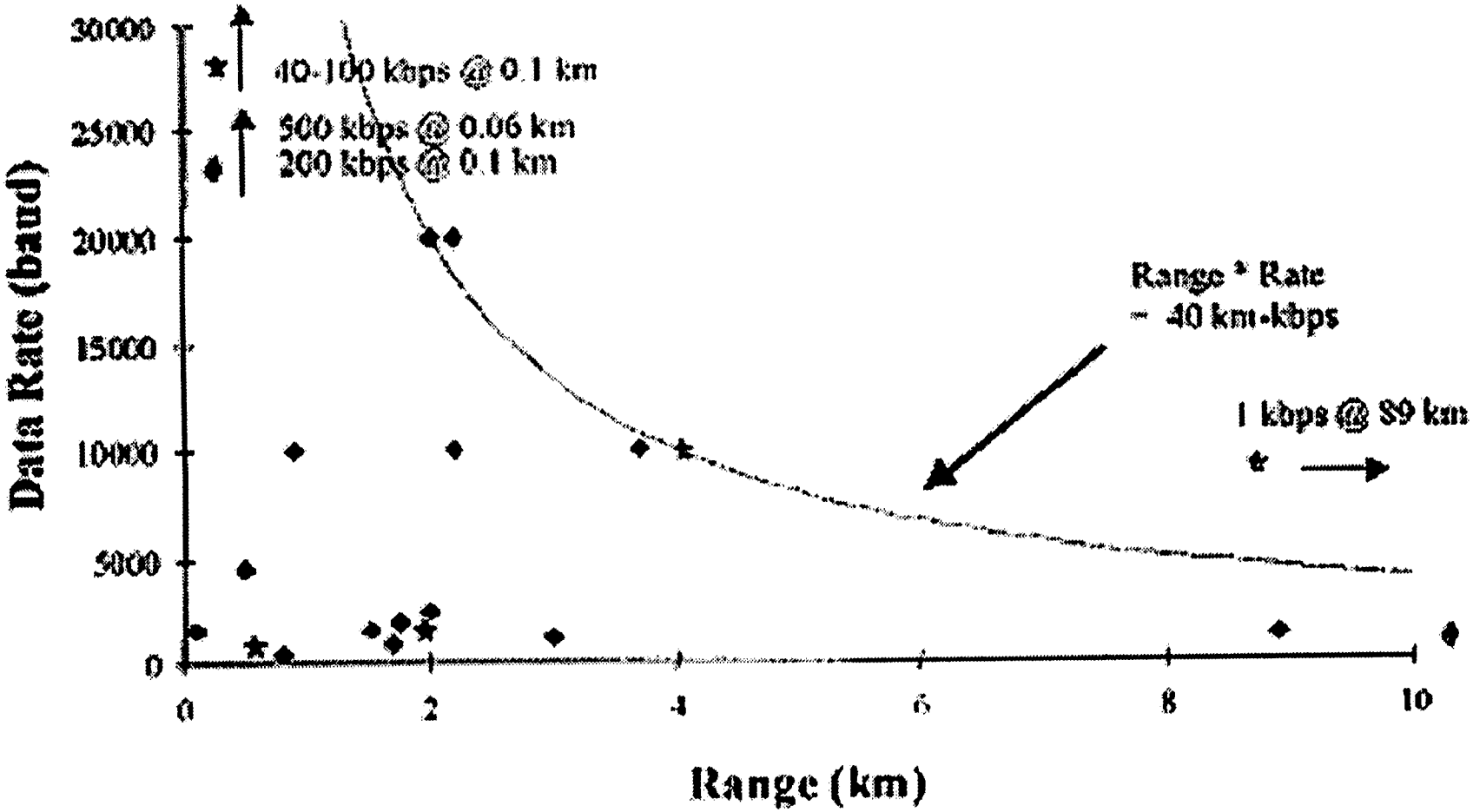
FIG. 3 is a graph showing experimental acoustic data rate vs range.

The underwater environment limits the penetration of both electromagnetic and acoustic signals to only very low frequencies. Acoustic carrier signals of approximately 10 kHz are typically used for sonar and communications, and electromagnetic signals of approximately 200 Hz are used for communications. Lower frequencies penetrate much farther underwater, and the low bit rates of the speech coding technique of the present invention will significantly extend the range of underwater acoustic speech transmission systems, as illustrated in FIG. 3. FIG. 3 is graph showing published experimental performance of underwater acoustic telemetry systems is summarized in this plot of range (km) versus data rate (kbit/s). The channels vary from deep and vertical to shallow and horizontal. In general, the high rate or high range results are for deep channels while the cluster of low range, low rate results are for shallow channels. Modems developed by the research community are represented with diamonds while stars denote commercially available systems. The range-rate bound represents an estimate of the existing performance envelope. While there are exceptions, most reviewed systems are bounded by the performance limit. FIG. 3 is extracted from Kilfoyle and Baggeroer, IEEE Journal of Oceanic Engineering, January 2000.

Underground Mine Communications

Wireless communication from the surface to the earth to deep underground has become a safety issue, but communicating wirelessly to depths of several hundred meters is not practical at frequencies above ~2 kHz. By going to lower carrier frequencies, the penetration is greatly enhanced. A frequency of approximately 1 KHz should have detectable signal at a depth of >100 m underground. The present invention allows speech communications systems to be built that are capable of wirelessly communicating from the surface to depths of >100 m.

Computer Gaming/Virtual Reality

Online computer games and virtual worlds have been created in which the players are represented online as 'avatars' which are seen by the other players in the game or world. Often these avatars look and act very different that the 'real-life' person. In an application of the present invention, the player's online avatar can speak the words of the player to the other online players, but in a voice of the players choosing, rather than his own. In this application of the invention, the object is not to mimic the speaker's voice, but to give it a different, more fanciful semblance, or to make all players speak with the same voice or set of voices.

Telephony

Telephone applications of all sorts can benefit from the present invention, either wireless, cellular, wired, Internet, or other. Bandwidth for voice communications is becoming more expensive, and more users are being added all the time. The present invention allows substantially more users to be accommodated in the same amount of bandwidth employed by current techniques.

While the present invention has been described in terms of specific embodiments, certain other modifications and improvements will therefore occur to those skilled in the art upon reading the foregoing description. The embodiment described herein is based on a specific architecture but the present invention is not so limited. So the scope of the invention should be determined by the appended claims and their legal equivalence.

What is claimed is:

1. A very low bit rate communication system comprising at a first location and at a second location:

A) a voice-to-text module including a microphone adapted to convert a speaker's voice to text, B) a first processor programmed with:

1) software to separate the text into individual words, 2) a first dictionary which providing a pre-assigned a specific multi-bit numeric value for each of a large number of individual words, 3) software to create a numeric stream from multi-bit numeric values, C) a transmitter adapted to transmit the numeric stream to a receiver;

D) a receiver adapted to receive the numeric stream,

E) a second processor programmed with:

1) a second dictionary identical or substantially identical to the first dictionary, 2) software to convert the numeric stream to text stream utilizing the second dictionary, and F) a text-to-speech module for converting the text stream to speech including a speaker to broadcast the speech.

2. The system as in claim 1 wherein said transmitter is an acoustic transmitter.

3. The system as in claim 1 wherein said transmitter is a radio transmitter.

4. The system as in claim 1 where each of the first and second dictionaries are identical and contain about 15,000 words.

5. The system as in claim 1 and further comprising a compression means at each location for compressing the numeric stream.

6. The system as in claim 1 wherein the processors are also programmed with encryption/decryption software.

7. The system as in claim 1 wherein the system is adapted for underwater communication.

8. The system as in claim 1 wherein the system is adapted for underground communication.

9. The system as in claim 1 wherein the system is adapted for computer gaming.

10. The system as in claim 1 wherein the system is adapted for virtual reality applications.

* * * * *